US012686419B2

(12) United States Patent
Wang et al.

(10) Patent No.: US 12,686,419 B2
(45) Date of Patent: Jul. 21, 2026

(54) COUPLER BUFFER DEVICE MOUNTING STRUCTURE WITH SMALL-FASTENING-TORQUE PUSHING UNDER COMPACT SPACE

(71) Applicant: CRRC Nanjing Puzhen Co., Ltd., Nanjing (CN)

(72) Inventors: Xingwen Wang, Nanjing (CN); Juxing Liang, Nanjing (CN); Kang Li, Nanjing (CN); Yulong Liu, Nanjing (CN)

(73) Assignee: CRRC Nanjing Puzhen Co., Ltd., Nanjing (CN)

( * ) Notice: Subject to any disclaimer, the term of this patent is extended or adjusted under 35 U.S.C. 154(b) by 421 days.

(21) Appl. No.: 18/559,827

(22) PCT Filed: Oct. 14, 2021

(86) PCT No.: PCT/CN2021/123698

§ 371 (c)(1),
(2) Date: Nov. 9, 2023

(87) PCT Pub. No.: WO2022/247104

PCT Pub. Date: Dec. 1, 2022

(65) Prior Publication Data

US 2024/0253675 A1 Aug. 1, 2024

(30) Foreign Application Priority Data

May 25, 2021 (CN) ..... 202110569023.4

(51) Int. Cl.
*B61G 9/04* (2006.01)
*B61G 9/20* (2006.01)

(52) U.S. Cl.
CPC *B61G 9/04* (2013.01); *B61G 9/20* (2013.01)

(58) Field of Classification Search
CPC ..... B61G 7/10; B61G 9/04; B61G 9/20
See application file for complete search history.

(56) References Cited

U.S. PATENT DOCUMENTS 4,338,037 A * 7/1982 Deminski ..... F16C 5/00 403/24
8,439,239 B2 * 5/2013 Lee ..... F16M 11/10 224/558

(Continued)

FOREIGN PATENT DOCUMENTS

AU 2017347558 A1 * 12/2018 ..... B61G 9/04
CA 2874802 C * 8/2017 ..... B61F 5/12

(Continued)

*Primary Examiner* — Jason C Smith
(74) *Attorney, Agent, or Firm* — Bayramoglu Law Offices LLC

(57) ABSTRACT

A coupler buffer device mounting structure for small-fastening-torque pushing under a compact space includes a double-headed stud passing through an installation fabrication hole of a vehicle body structure; a nut screwed on a first end of the double-headed stud; a push nut screwed on a second end of the double-headed stud and provided with a plurality of axial screw holes in a circumferential direction; and a plurality of push screws screwed into the circumferentially provided axial screw holes of the push nut, where the coupler buffer device is clamped and fixed to the vehicle body structure by heads abutting against the coupler buffer device via a hard washer. The coupler buffer device mounting structure achieves the passing of the double-headed stud from a coupler side to a vehicle body side by using the double-headed stud, the nut, the push nut and the plurality of push screws in combination.

13 Claims, 2 Drawing Sheets

(56) References Cited

U.S. PATENT DOCUMENTS

| | | | | |
|---|---|---|---|---|
| 10,396,448 | B2 * | 8/2019 | Schmutzler | H01Q 1/42 |
| 2014/0348610 | A1 * | 11/2014 | Davis | F16B 5/025 411/214 |
| 2024/0253675 | A1 * | 8/2024 | Wang | B61G 7/10 |
| 2025/0162623 | A1 * | 5/2025 | Gylling | B61G 9/20 |

FOREIGN PATENT DOCUMENTS

| | | | | | |
|---|---|---|---|---|---|
| CN | 200964116 | Y | | 10/2007 | |
| CN | 200989362 | Y | * | 12/2007 | |
| CN | 101348121 | A | * | 1/2009 | |
| CN | 207875667 | U | | 9/2018 | |
| CN | 110539773 | A | | 12/2019 | |
| CN | 211599493 | U | * | 9/2020 | |
| CN | 212098860 | U | | 12/2020 | |
| CN | 213088471 | U | | 4/2021 | |
| CN | 113120021 | A | | 7/2021 | |
| CN | 114162162 | B | * | 4/2023 | B61F 1/08 |
| EP | 0344394 | B1 | * | 12/1991 | B61G 11/16 |
| GB | 2300127 | A | * | 10/1996 | A63H 19/18 |
| KR | 101641984 | B1 | * | 7/2016 | B60P 3/00 |
| KR | 102860365 | B1 | * | 9/2025 | H10P 72/3202 |

* cited by examiner

COUPLER BUFFER DEVICE MOUNTING STRUCTURE WITH SMALL-FASTENING-TORQUE PUSHING UNDER COMPACT SPACE

CROSS REFERENCE TO THE RELATED APPLICATIONS

This application is the national phase entry of International Application No. PCT/CN2021/123698, filed on Oct. 14, 2021, which is based upon and claims priority to Chinese Patent Application No. 202110569023.4, filed on May 25, 2021, the entire contents of which are incorporated herein by reference.

TECHNICAL FIELD

In particular, the present invention relates to a coupler buffer device mounting structure for small-fastening-torque pushing under a compact space, and belongs to the technical field of coupler buffer device mounting structures.

BACKGROUND

The coupler buffer device is a vehicle component for coupling the vehicles to each other, and transmitting tractive force, braking force, and relieving longitudinal impact force. It is a whole body composed of a coupler, a bumper, a trail hook frame, a slave plate and so on, which is installed in a traction beam at a chassis end.

It has been found by searching that the Chinese utility model patent CN207875667U discloses a mounting plate and a coupler mounting structure, wherein a groove is provided on a side surface of the mounting plate; the groove is used for accommodating a nut and can limit the rotation of the nut, a bolt mounting hole is provided at a bottom of the groove in a limited mounting space of a chassis of a vehicle body; and the coupler can be quickly and conveniently mounted and dismounted without other tooling. The patent focuses on the mounting plate groove structure for preventing a fastener from rotating, and does not consider the use of a small mounting fastening torque, while the rear mounting space is a through area and is not limited by the mounting operation space.

SUMMARY

The object of the present invention is mainly to solve the above-mentioned problems of the prior art, and to provide a coupler buffer device mounting structure for small-fastening-torque pushing under a compact space so as to realize the small-fastening-torque mounting of the coupler buffer device in a compact operating space by means of the cooperation of a double-headed stud and a push nut.

In order to solve the above technical problem, the present invention provides a coupler buffer device mounting structure for small-fastening-torque pushing under a compact space, characterized by comprising:

- a double-headed stud passing through an installation fabrication hole of a vehicle body structure;
- a nut screwed on a first end of the double-headed stud;
- a push nut screwed on a second end of the double-headed stud and provided with a plurality of axial screw holes in a circumferential direction; and
- a plurality of push screws screwed into the circumferentially provided axial screw holes of the push nut, wherein the coupler buffer device is clamped and fixed to the vehicle body structure by heads abutting against the coupler buffer device via a hard washer.

The invention has the following beneficial effects.

The present invention achieves the passing of the double-headed stud from a coupler side to a vehicle body side by using the double-headed stud, the nut, the push nut and the plurality of push screws in combination, and solves the problem that a bolt cannot pass to the coupler side from the vehicle body side due to a small closed space on the vehicle body side by fastening a plurality of small screws on a coupler buffer device side (the vehicle body side is a small cavity and cannot be operated by applying a fastening torque).

The small screw adopts a small fastening torque, and a plurality of thrusting forces generated by the small screw act on the hard washer to achieve a strong clamping force. At the same time, these thrusting forces will generate a tensile force of the same magnitude in the combination of the double-headed studs, so as to achieve the installation of the coupler buffer device, and solve the problem of stress concentration at the root of the bolt caused by the bolt passing from the coupler side to the vehicle body side in the original structure.

The double-headed stud is pre-formed with a raised head on a coupler side. The stud may be removed by using the raised head via a small wrench to complete the dismounting of the coupler buffer device.

Furthermore, the present invention also sets forth a coupler buffer device, wherein the coupler buffer device mounting structure according to any one of claims 1 to 5 is fixed to a vehicle body structure.

The invention also sets forth a rail vehicle characterized by having a coupler buffer device mounting structure according to any one of claims 1 to 5.

Figure 1:
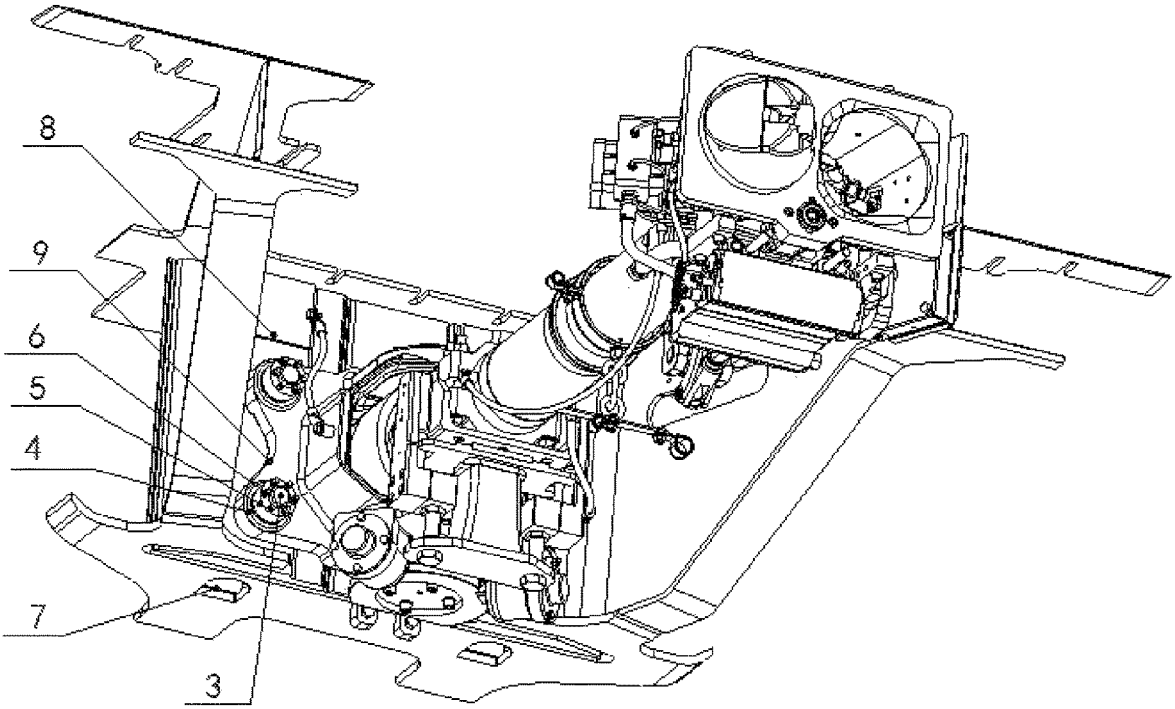
FIG. 1 is a schematic view showing the mounting of a coupler buffer device according to the present invention.
Figure 2:
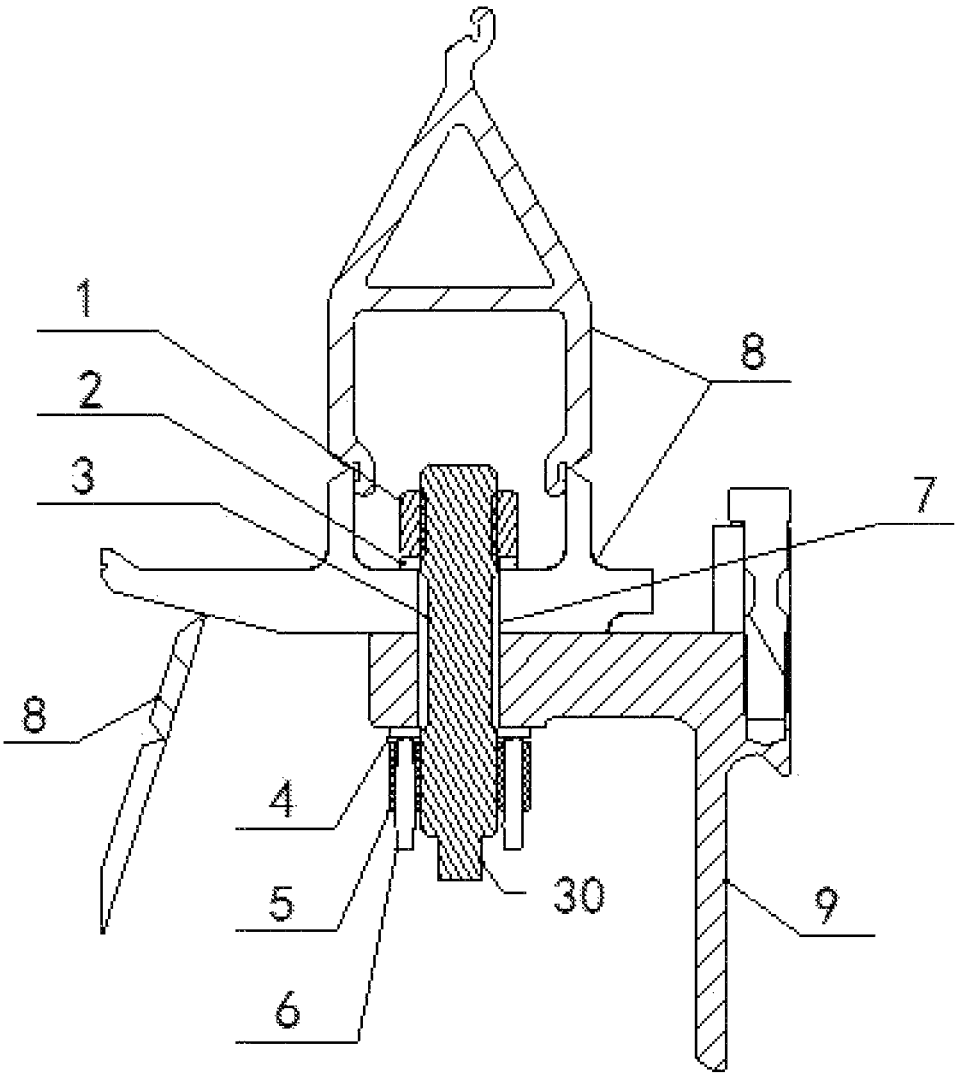
FIG. 2 is a sectional view of a coupler buffer device mounting structure according to the present invention.

The reference numbers in the drawings are as follows.

1—sleeper beam, 2—floor connection beam, 3—corrugated floor, 4—side beam, 5—fastener, 6—push screw, 7—installation fabrication hole, 8—vehicle body structure, 9—coupler buffer device.

DETAILED DESCRIPTION OF THE EMBODIMENTS

Hereinafter, embodiments of the present invention will be explained with reference to the accompanying drawings.

A coupler buffer device mounting structure for small-fastening-torque pushing under a compact space according to the present example is characterized by including:

- an M36 double-headed stud 3 passing through an installation fabrication hole 7 of a vehicle body structure 8, wherein the double-headed stud 3 is pre-formed with a raised head 30 on a coupler side;
- a nut 1 screwed on a first end of the double-headed stud 3, wherein a toothed washer 2 is arranged between the nut 1 and the vehicle body structure 8 (the nut 1 and the toothed washer may also be in the form of an integral piece);
- a push nut 5 screwed on a second end of the double-headed stud 3 and provided with a plurality of axial screw holes in a circumferential direction; and six push screws 6 screwed into the circumferentially provided axial screw holes of the push nut 5, wherein the coupler buffer device 9 is clamped and fixed to the vehicle body structure 8 by heads abutting against the coupler buffer device 9 via a hard washer 4.

Functional Principles

With the double-headed stud 3 of the M36, the fastening is achieved by means of an push nut 5 and an push screw 6;

By tightening the push screw 6, a jacking force (axial) is generated, which acts directly on the hard washer 4. Each push screw 6 has a small friction diameter and a small fastening torque, but the jacking forces of a plurality of push screws 6 combine to react the push nut 5, which in turn creates a large reaction force on the double-headed stud 3.

The jacking force of the push screw 6, together with the jacking force of the double-headed stud 3, produces a required clamping force on the joint surfaces of the hard washer 4, the coupler buffer device and the vehicle body.

With the toothed washer 2, the looseness prevention of the mounting and fastening of the coupler buffer device is ensured.

Mounting a coupler buffer device of a rail vehicle with the coupler buffer device mounting structure of this example includes the steps of:

step 1, lifting a coupler buffer device 9 to a vehicle body installation position;

step 2, allowing a double-headed stud 3 through an installation fabrication hole 7 of a vehicle body structure 8 and an installation hole of the coupler buffer device 9, and screwing a toothed washer 2 and a nut 1 on a first end of the double-headed stud 3;

step 3, sleeving a hard washer 4 on a second end of the double-headed stud 3 from the outside, screwing a push nut 5 on a second end of the double-headed stud 3, and then successively tightening a push screw 6, so that the push screw 6 abuts against an outer end face of the coupler buffer device 6; the push screw 6 is screwed by a torque wrench in step 3, and the restraining moment is set to about 70 N. m.

step 4, checking that a clearance value between the hard washer 4 and the push nut 5 is within a design range and marking the tightening.

A method for disassembling a coupler buffer device of a rail vehicle includes the steps of:

step 1, suspending the coupler buffer device to ensure that it does not fall off after a fastener is removed;

step 2, unscrewing the push screw 6 by using a torque wrench to disengage same from a hard washer 4;

step 3, manually unscrewing and removing a push nut 5;

step 4, unscrewing a double-headed stud 3 and removing the double-headed stud 3, a nut 1 and a toothed washer 2;

step 5, dismounting and removing the coupler buffer device.

In addition to the examples described above, other embodiments of the invention are possible. Any technical solution formed by equivalent substitution or equivalent transformation falls within the protection range claimed by the invention.

What is claimed is:

1. A coupler buffer device mounting structure, comprising:

a double-headed stud passing through an installation fabrication hole of a vehicle body structure from a coupler side toward a vehicle body side, wherein the vehicle body side defines a cavity and wherein fastening operations cannot be performed on the vehicle body side;

a nut screwed on a first end of the double-headed stud;

a push nut screwed on a second end of the double-headed stud and provided with a plurality of axial screw holes in a circumferential direction; and a plurality of push screws screwed into the plurality of axial screw holes of the push nut, wherein a coupler buffer device is clamped and fixed to the vehicle body structure by heads of the plurality of push screws abutting against the coupler buffer device via a hard washer, and wherein tightening the plurality of push screws from the coupler side generates a plurality of jacking forces that act directly on the hard washer to clamp and fix the coupler buffer device to the vehicle body structure.

2. The coupler buffer device mounting structure according to claim 1, wherein a toothed washer is arranged between the nut and the vehicle body structure.

3. A method for dismounting a coupler buffer device of a rail vehicle in a closed space on a vehicle body side, by using the coupler buffer device mounting structure according to claim 2, the method comprising the steps of:

step 1, suspending the coupler buffer device to ensure that the coupler buffer device does not fall off after a fastener is removed;

step 2, unscrewing the plurality of push screws from the coupler buffer device side by using a torque wrench to disengage the plurality of push screws from the hard washer;

step 3, manually unscrewing and removing the push nut;

step 4, unscrewing the double-headed stud and removing the double-headed stud, the nut and the toothed washer; and step 5, dismounting and removing the coupler buffer device.

4. The coupler buffer device mounting structure according to claim 2, wherein the nut is integral with the toothed washer.

5. A method for mounting a coupler buffer device of a rail vehicle in a closed space on a vehicle body side, wherein the operation of fixing by the coupler buffer device mounting structure according to claim 2 comprises the steps of:

step 1, lifting the coupler buffer device to a vehicle body installation position;

step 2, allowing the double-headed stud through the installation fabrication hole of the vehicle body structure and an installation hole of the coupler buffer device from a coupler side to a vehicle body side, and arranging the toothed washer between the nut and the vehicle body structure, and screwing the nut on the first end of the double-headed stud;

step 3, sleeving the hard washer on the second end of the double-headed stud from an outside, screwing the push nut on the second end of the double-headed stud, on a coupler buffer device side, and then successively tightening the plurality of push screws from the coupler buffer device side, so that heads of the plurality of push screws abut against the hard washer, and the hard washer abuts against an outer end face of the coupler buffer device; and step 4, checking that a clearance value between the hard washer and the push nut is within a predetermined clearance range and applying a witness mark indicating completion of tightening of the push nut.

6. The method for mounting the coupler buffer device of the rail vehicle according to claim 5, wherein each of the push screws are screwed by a torque wrench in step 3, and a tightening torque is set to about 70 N. m for each push screw.

7. The coupler buffer device mounting structure according to claim 1, wherein a number of the plurality of push screws is six.

8. The coupler buffer device mounting structure according to claim 1, wherein the double-headed stud is pre-formed with a raised head on a coupler side.

9. A rail vehicle having the coupler buffer device mounting structure according to claim 1.

10. The rail vehicle having the coupler buffer device mounting structure according to claim 9, wherein in the coupler buffer device mounting structure, a toothed washer is arranged between the nut and the vehicle body structure.

11. The rail vehicle having the coupler buffer device mounting structure according to claim 10, wherein in the coupler buffer device mounting structure, the nut is integral with the toothed washer.

12. The rail vehicle having the coupler buffer device mounting structure according to claim 9, wherein in the coupler buffer device mounting structure, a number of the plurality of push screws is six.

13. The rail vehicle having the coupler buffer device mounting structure according to claim 9, wherein in the coupler buffer device mounting structure, the double-headed stud is pre-formed with a raised head on a coupler side.

* * * * *